US006672738B1

(12) United States Patent
Lewis et al.

(10) Patent No.: US 6,672,738 B1
(45) Date of Patent: Jan. 6, 2004

(54) DECORATIVE ORNAMENT

(76) Inventors: James M. Lewis, 11405 Alabama Hwy. 33, Moulton, AL (US) 35650; Elizabeth B. Lewis, 11405 Alabama Highway 33, Moulton, AL (US) 35650

( * ) Notice: Subject to any disclaimer, the term of this patent is extended or adjusted under 35 U.S.C. 154(b) by 161 days.

(21) Appl. No.: 09/717,031

(22) Filed: Nov. 22, 2000

(51) Int. Cl.[7] ..... F21V 23/04

(52) U.S. Cl. ..... 362/251; 315/185 S; 315/241 R; 362/20; 362/126

(58) Field of Search ..... 363/13, 143, 20, 363/126; 362/251; 315/185 R, 187, 188, 185 S, 241 R, 186

(56) References Cited

U.S. PATENT DOCUMENTS

| | | | | | |
|---|---|---|---|---|---|
| 2,839,670 | A | | 6/1958 | Gladstone | 240/2 |
| 3,544,950 | A | | 12/1970 | Lopez et al. | 339/17 |
| 3,878,469 | A | * | 4/1975 | Bolasny | 123/538 |
| 4,363,081 | A | | 12/1982 | Wilbur | 362/98 |
| 4,537,806 | A | | 8/1985 | Sherrard | 428/7 |
| 5,037,309 | A | | 8/1991 | Abe et al. | 439/56 |
| 5,045,768 | A | * | 9/1991 | Pelly | 320/164 |
| 5,129,829 | A | | 7/1992 | Arnold et al. | 439/56 |
| 5,185,560 | A | * | 2/1993 | Nilssen | 315/219 |
| 5,807,122 | A | | 9/1998 | Heeb et al. | 439/83 |
| 5,822,898 | A | | 10/1998 | Weissleder | 40/442 |
| 5,829,862 | A | | 11/1998 | Ferrell | 362/32 |
| 6,272,030 | B1 | * | 8/2001 | Oomura | 363/126 |

FOREIGN PATENT DOCUMENTS

| | | |
|---|---|---|
| GB | 2094622 | 9/1982 |

* cited by examiner

*Primary Examiner*—Sandra O'Shea
*Assistant Examiner*—John Anthony Ward
(74) *Attorney, Agent, or Firm*—Welsh & Flaxman LLC

(57) ABSTRACT

The invention relates to a decorative ornament. The ornament includes a circuit board shaped in an aesthetically desirable manner to provide a background for the decorative ornament, a plurality of light sources, an integrated circuit and circuit leads being mounted on the circuit board. The circuit leads electrically couple the light sources with the integrated circuit to control the light pattern displayed by the decorative ornament. The circuit leads, light sources and circuit boards working together to create an aesthetically pleasing ornament.

9 Claims, 12 Drawing Sheets

Zeners cathode connected, switching diodes annode connected

Zeners anode connected, switching diodes cathode connected

DECORATIVE ORNAMENT

BACKGROUND OF THE INVENTION

1. Field of the Invention

The invention relates to decorative ornaments. More particularly, the invention relates to a decorative ornament formed on printed circuit board.

2. Description of the Prior Art

Many advances in the development of circuit boards have been made in recent years. The advances have improved the versatility, speed and general operating characteristics of the boards. These advances have been taken advantage of in a variety of ways with the exception of using the raw printed circuit boards as aesthetically desirable objects.

While circuit boards have been incorporated into displays of various types, prior art developers have invariably chosen to hide the circuit boards while developing a different facade for viewing. As such, the potential versatility of circuit boards has been left substantially undeveloped in the area of decorative ornaments.

The present invention takes advantage of the versatility offered by printed circuit boards to provide a decorative ornament in which the circuit board forms an integral part of the resulting ornament.

SUMMARY OF THE INVENTION

It is, therefore, an object of the present invention to provide a decorative ornament. The ornament includes a circuit board shaped in an aesthetically desirable manner to provide a background for the decorative ornament, a plurality of light sources, an integrated circuit and circuit leads being mounted on the circuit board. The circuit leads electrically couple the light sources with the integrated circuit to control the light pattern displayed by the decorative ornament.

It is also an object of the present invention to provide a decorative ornament wherein the circuit board is double sided.

It is another object of the present invention to provide a decorative ornament wherein the plurality of light sources and circuit leads are applied to both sides of the circuit board.

It is a further object of the present invention to provide a decorative ornament wherein the circuit board is in the shape of a tree and the circuit leads are shaped and dimensioned to resemble branches of the tree.

It is also another object of the present invention to provide a decorative ornament including a plurality of resistors and capacitors mounted on the circuit board. The resistors and capacitors are electrically associated with the light sources, integrated circuit and circuit leads.

It is yet a further object of the present invention to provide a decorative ornament including a switch for controlling the blinking pattern of the light sources.

It is still another object of the present invention to provide a decorative ornament including a switch for controlling the color of the light sources.

It is also an object of the present invention to provide a decorative ornament wherein the light sources are light emitting diodes.

It is another object of the present invention to provide a decorative ornament including a connector for selective coupling to a light string.

It is a further object of the present invention to provide a decorative ornament wherein the decorative ornament is a pin.

It is also another object of the present invention to provide a decorative ornament wherein the pin includes latching members, and the latching members complete the electrical circuit when brought together for attachment to a support surface.

It is still a further object of the present invention to provide a decorative ornament wherein the circuit board is glass.

It is another object of the present invention to provide a decorative ornament wherein the circuit board is transparent.

It is also an object of the present invention to provide a decorative ornament including a circuit converting AC to DC.

It is yet another object of the present invention to provide a decorative ornament wherein the circuit converting AC to DC includes at least one zener diode.

It is also an object of the present invention to provide a circuit converting AC to DC. The circuit includes an AC input, an AC output and a zener diode coupled between the AC input and the AC output. The zener diode regulates the flow of electricity such that direct current is provided between first and second nodes to which a direct current device is selectively coupled.

It is another object of the present invention to provide a circuit including a capacitor positioned between the AC input and AC output for regulating the flow of electricity to the first and second nodes.

It is a further object of the present invention to provide a circuit including a diode positioned between the AC input and AC output for regulating the flow of electricity to the first and second nodes.

It is also another object of the present invention to provide a circuit including a second zener diode and a second diode.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
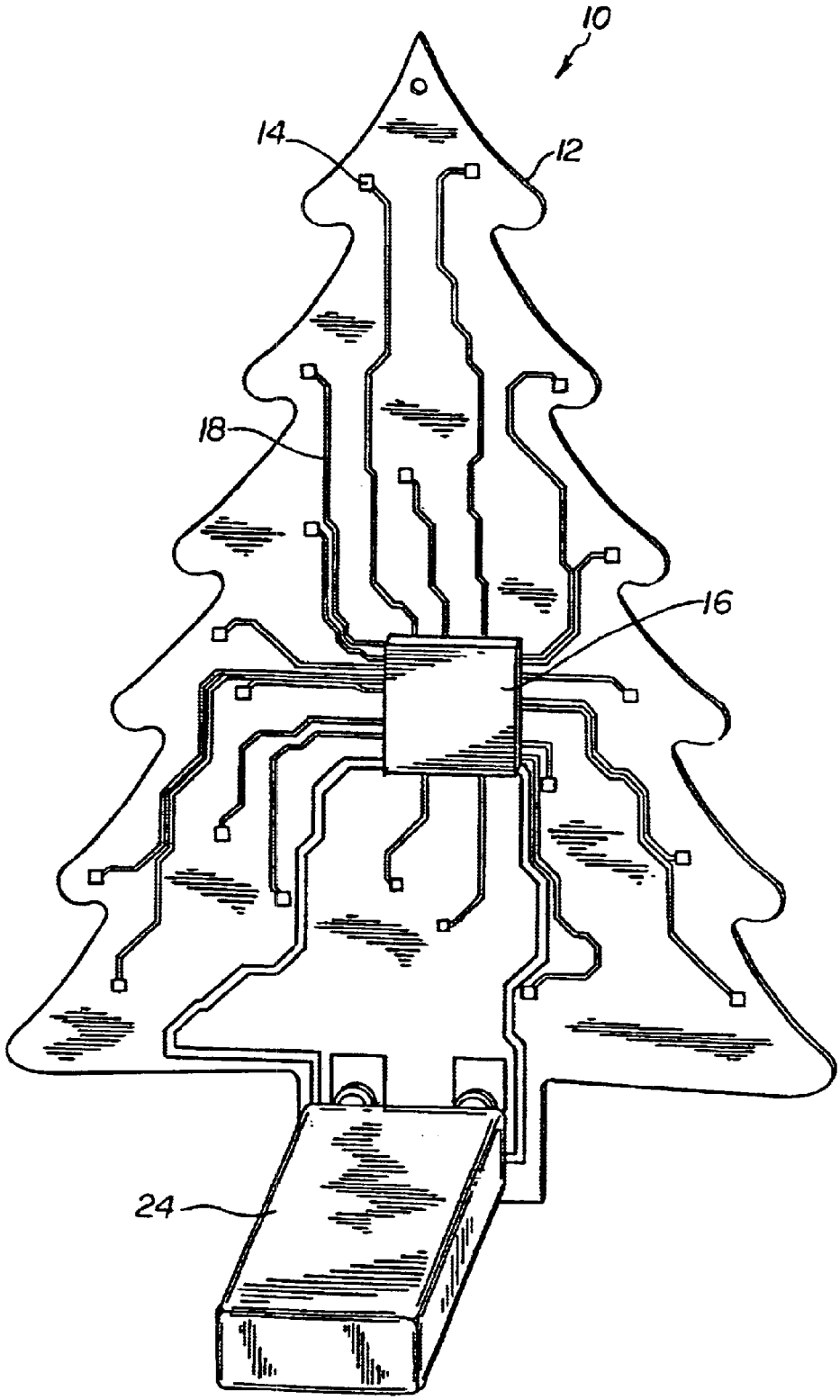
FIG. 1 is a perspective view of a decorative ornament in accordance with the present invention.

With reference to FIG. 1, a decorative ornament 10 is disclosed. The decorative ornament 10 generally includes a printed circuit board 12 shaped in an aesthetically desirable manner to provide a background for the decorative ornament 10, a plurality of light sources 14, an integrated circuit 16 and circuit leads 18 mounted on the circuit board 12. The circuit leads 18 electrically couple the light sources 14 with the integrated circuit 16 to control the light pattern displayed by the decorative ornament 10.

According to a preferred embodiment of the present invention, the circuit board 12 is a conventional board used in the manufacture of electronic devices. In accordance with a preferred embodiment of the present invention, the circuit board 12 is an FR4 (fiberglass and resin) board. However, and as will be discussed below, it is contemplated that other board materials, for example, glass, plastic and paper, may be used without departing from the spirit of the present invention. Similarly, the circuit board may be manufactured in a variety of ways known to those of ordinary skill in the art.

As with conventional circuit boards, an integrated circuit 16 and circuit leads 18 are applied to the circuit board 12. The circuit leads 18 link the integrated circuit 16 to a plurality of LEDs 14 flight emitting diodes) bound to the circuit board 12 for controlling the operation of the LEDs 14.

The integrated circuit 16 is generally programmed to control the passage of electrical charge to the various LEDs 14 dispersed on the surface of the circuit board 12. In accordance with a preferred embodiment of the present invention, the integrated circuit 16 is a programmable logic device (PLD) manufactured by Altera. Other programmable logic devices, as well as microprocessors, ASICs (Application Specific Integrated Circuits), and other integrated circuits, may be used within the spirit of the present invention, for example. However, at the present time PLDs are a desirable low cost solution allowing for ready pattern and design changes.

As previously mentioned above, the circuit leads 18 link the integrated circuit 16 with the LEDs 14. The circuit leads 18 provide a further aesthetic function in replicating structural features which might be desirable to include on the surface of the circuit board 12. For example, and with reference to FIG. 1, where the decorative ornament is intended to replicate a Christmas tree, the circuit leads 18 are applied in such a way to resemble the branches of the Christmas tree. As such, the circuit leads 18 are not necessarily applied in the most efficient manner, but are applied with an eye toward enhancing the aesthetic features of the decorative ornament 10 to which they are attached.

Figure 2:
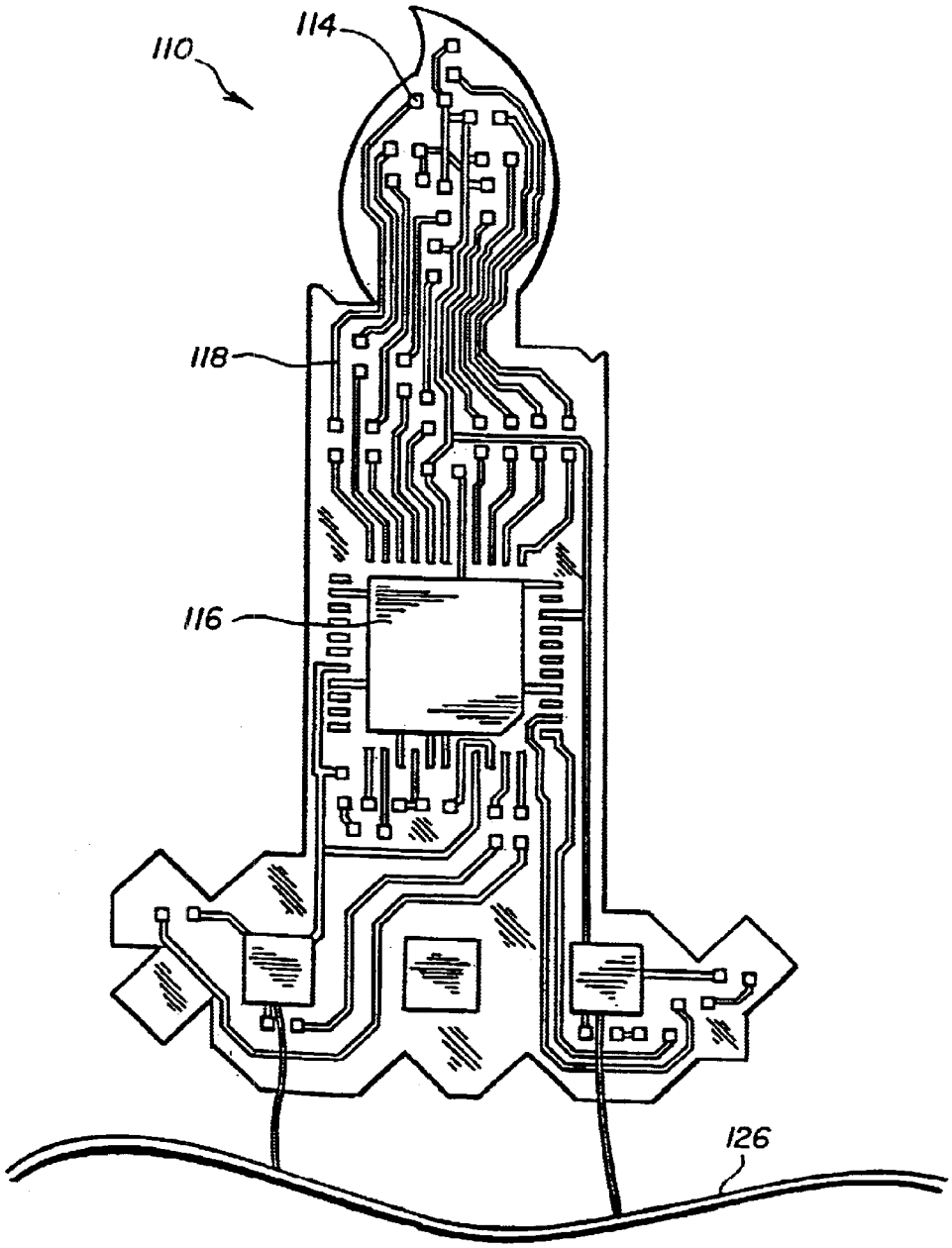
FIG. 2 is a perspective view of an alternate embodiment in accordance with the present invention.

A further example is shown in FIG. 2, where a decorative ornament 110 resembling a candle is shown. In accordance with this embodiment, the circuit leads 118 are applied in such a way to resemble the dripping wax commonly found on a lit candle. It is further contemplated that the leads may form the veins within a heart, the scales of a fish, the petals of a flower, facial features of cartoon characters etc.

The LEDs 14, 114 are bound to the circuit board 12, 112 using conventional bonding techniques. In accordance with a preferred embodiment, surface mount technology is used in bonding the LEDs to the circuit board, although other techniques may be used without departing from the spirit of the present invention. Generally, surface mount technology (SMT) boards differ from conventional boards in that the component leads are soldered to conductive "pads" disposed on the surface to which the particular component is to be mounted. The leads, therefore, need not, and generally do not, pass through holes to the opposite surface of the board. The procedures for producing SMT board assemblies are generally simpler and more economical than other procedures used to fabricate board assemblies. Further, SMT board assemblies permit reductions in the sizing of the individual components mounted on the boards and reductions in the size of the boards as well. They also permit the unrestricted mounting of components on both surfaces of the boards, thus providing denser assemblies, i.e. with increased circuitry disposed in less space.

The LEDs 14, 114 may be single color devices (see FIG. 1) or multiple color devices (see FIG. 2). In accordance with a preferred embodiment of the present invention, LEDs from Lumex, Dialight, Lite-On, Sharp, and HP have been used, although various LEDs may be used without departing from the spirit of the present invention.

Ultimately, the actuation of the various LEDs 14, 114 is controlled by the integrated circuit 16, 116 which uses known programming techniques to control the sequence and color of the various LEDs 14, 114 bound to the circuit board 12, 112.

In addition to the integrated circuit 16, 116, LEDs 14, 114 and circuit leads 18, 118 secured to the circuit board 12, 112, various resistors 20, 120 and capacitors 22, 122 may be applied between the integrated circuit 16, 116 and the LEDs 14, 114 for controlling the current applied to the LEDs 14, 114.

Power may be supplied to the decorative ornament by either a power source secured directly to the circuit board 12 (see FIG. 1 where, for example, a battery 24 is the power source) or via a power line coupled to an external power source (see FIG. 2 where, for example, the decorative ornament 110 is linked to a string of Christmas lights 126).

Referring to FIGS. 3 to 6, various embodiments of the decorative ornaments in accordance with the present invention are disclosed. Specifically, and with reference to FIG. 3, the decorative ornament 210 may be as a double sided circuit. In accordance with this embodiment, the various electrical elements are applied to opposite side of the circuit board 212 to form a decorative ornament that may be viewed from opposite sides.

Figure 3:
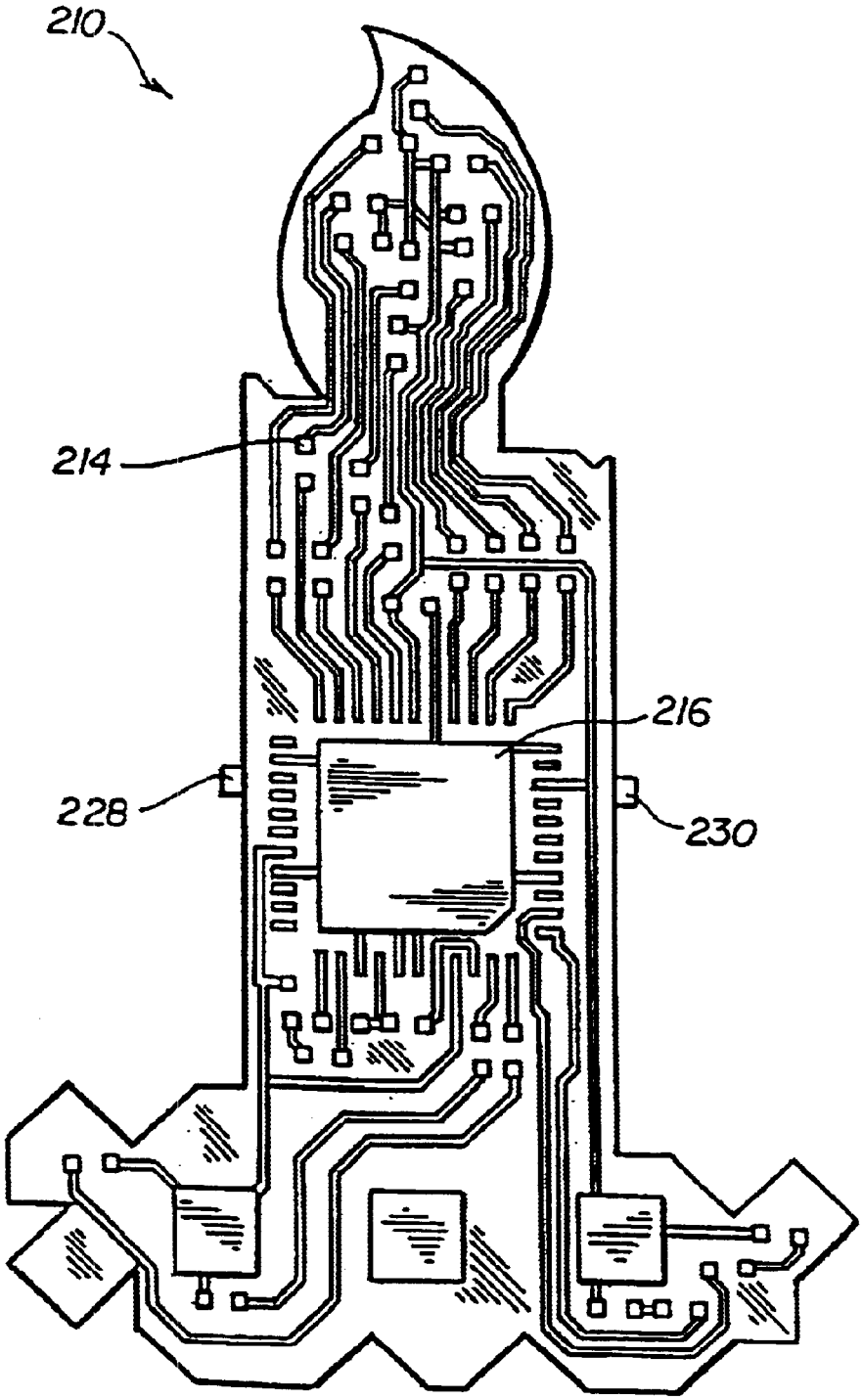
FIG. 3 is a perspective view of a further alternate embodiment in accordance with the present invention.

Also with reference to FIG. 3, a decorative ornament 210 including switches for controlling the functioning of the ornament is disclosed. The decorative ornament 210 includes a first switch 228 linked to the integrated circuit 216 for controlling the blinking pattern of the light sources 214. The decorative ornament 210 further includes a second switch 230 linked to the integrated circuit 216 for controlling the color of the light sources 214.

Figure 4:
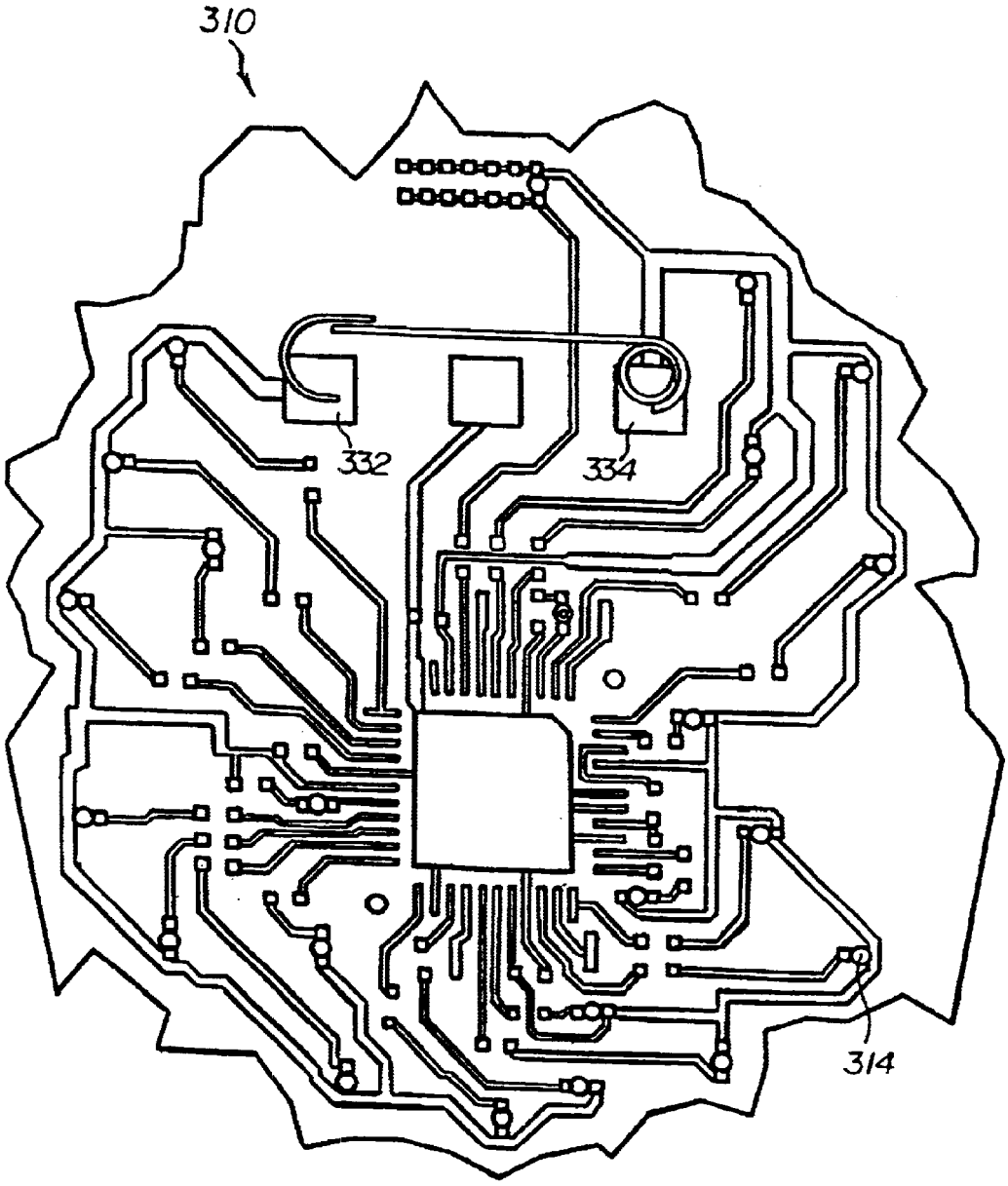
FIG. 4 is a perspective view of a decorative ornament pin in accordance with the present invention.

As shown in FIG. 4, the decorative ornament 310 may also take the form of a pin. The electrical elements are substantially identical to those discussed above with reference to FIGS. 1 and 2, but include a latching member 332 which forms the on/off switch for the decorative ornament. Specifically, the latch 332 forms part of the electrical circuit coupling the LEDs 314 to the power source 334. As such, when the latch 332 is closed (presumably securing the pin to an article of clothing or other object) power passes therethrough and to the LEDs 314. When the pin is not being worn, and the latch 332 is left open, no power passes therethrough and the LEDs 314 remain unlit.

In addition to the conventional circuit board materials discussed above, it is contemplated that the circuit board in accordance with the present invention may take the form of a translucent glass, plastic or resin through which one would be able to view the light emitted by the LEDs. For example, the FR4 boards disclosed above are sufficiently transparent to permit the passage of visible emitted light therethrough.

Figure 5:
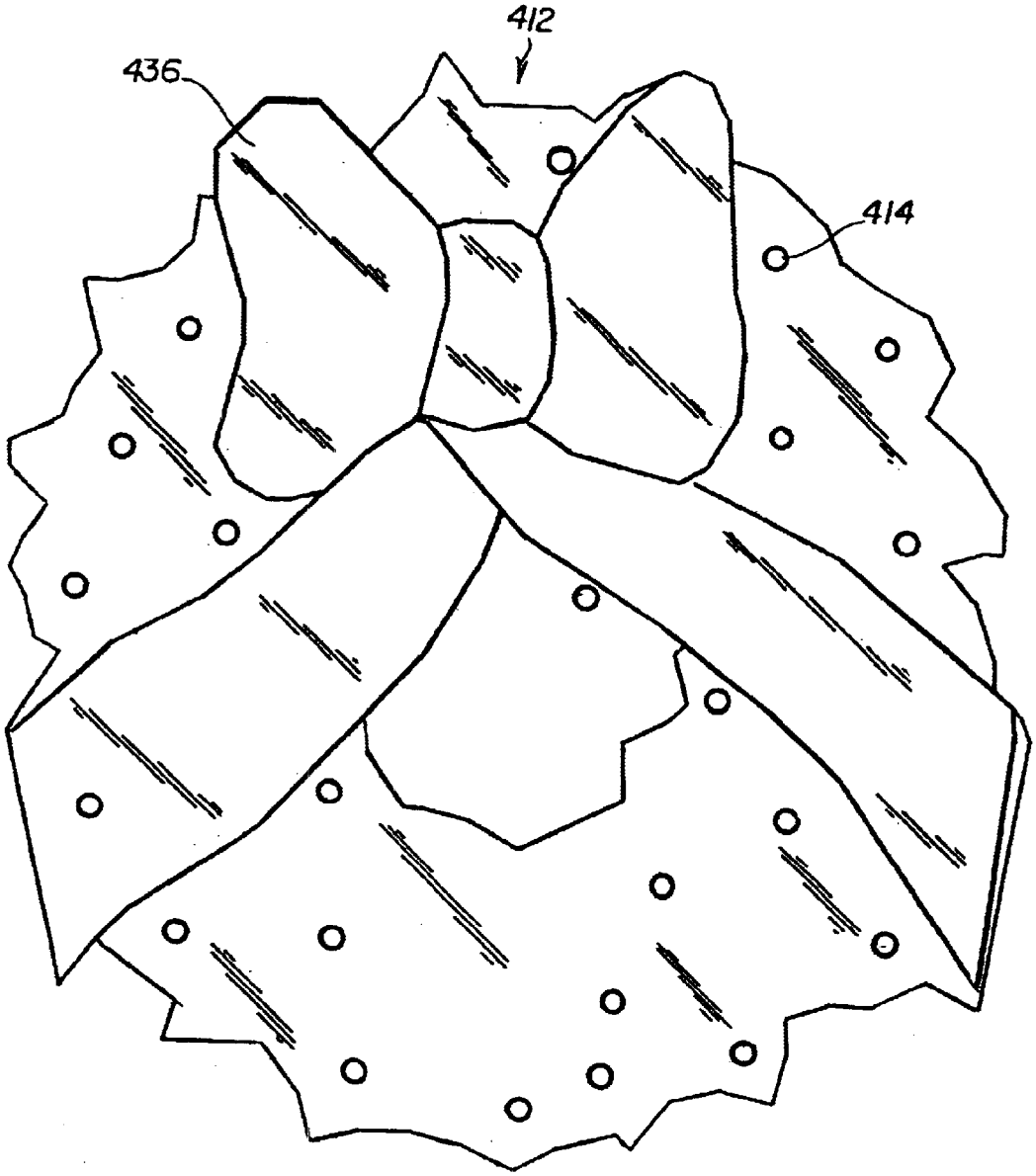
FIG. 5 is a front side view of a decorative ornament in accordance with the present invention.
Figure 6:
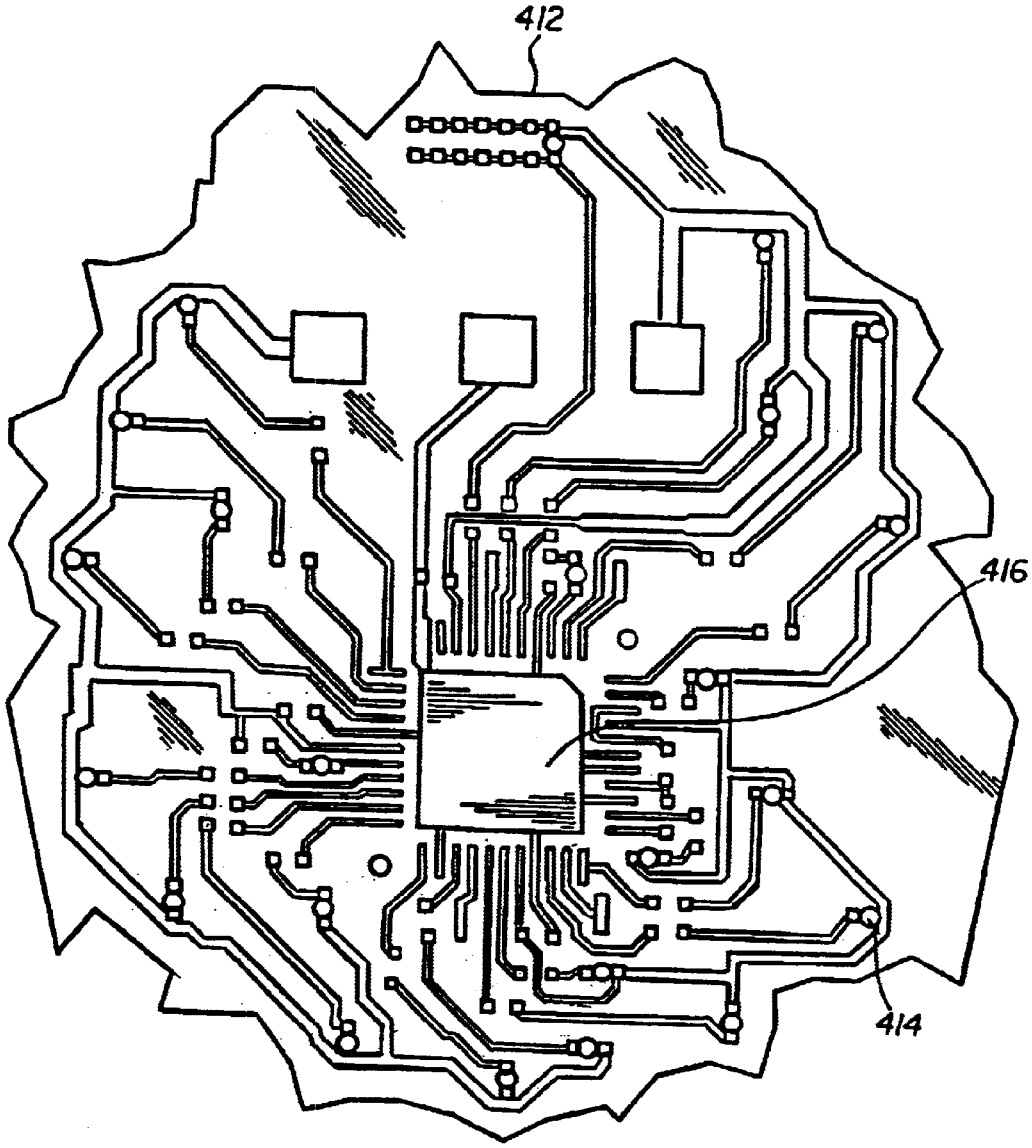
FIG. 6 is a backside view of the decorative ornament shown in FIG. 5.

In accordance with this embodiment, and with reference to FIGS. 5 and 6, the LEDs 414, circuit leads 418 and integrated circuit 416 are back mounted on the circuit board 412 (also using surface mount technology). When the circuit is active and the front 436 of the circuit board 412 is viewed, the emitted light will pass through the circuit board 412, producing a desirable lighting effect. The glass, plastic or resin making up the circuit board 412 may be colored to improve the aesthetic effect.

Where glass is used, it is contemplated that the circuit leads may be formed by silk screening conductive ink onto the glass in the same way that hybrid circuits are made on ceramic substrates. Another method for achieving this embodiment is to bond copper to the glass, and then to use photo-resistive material to etch the proper pattern of traces as is currently done with printed circuit boards.

The embodiment disclosed in FIGS. 1 to 6, may be applied in the manufacture of decorative ornaments including simple ornaments, windows, lamp shades, mugs, glasses and other devices commonly manufactured from stained glass.

Where it is not desired to specifically apply the electrical components to the glass or plastic as discussed above, it may be desirable to secure a translucent piece of glass or plastic adjacent the circuit board to provide a view of blinking lights through the adjacent glass or plastic. This embodiment may be ultimately fabricated with the LEDs facing the translucent surface or with the LEDs facing away from the translucent surface where the circuit board is structured to allow of the passage of LED emitted light and ambient light therethrough.

As mention above with reference to FIG. 2, power may be supplied to ornaments in accordance with the present invention via a string of Christmas lights, for example. Since the present ornaments are designed as DC (direct current) devices, circuitry has been developed which allows for attachment of the ornaments to a line of lights arranged in series and powered by an AC (alternating current) source. Where the lights are arranged in parallel, a bridge rectifier may be applied to convert the AC to DC for use by the present ornament. However, a bridge rectifying will not work where the lights are arranged in series; the bridge rectifier, when used with lights arranged in series, limits the current flowing to other devices in the series.

Figure 7:
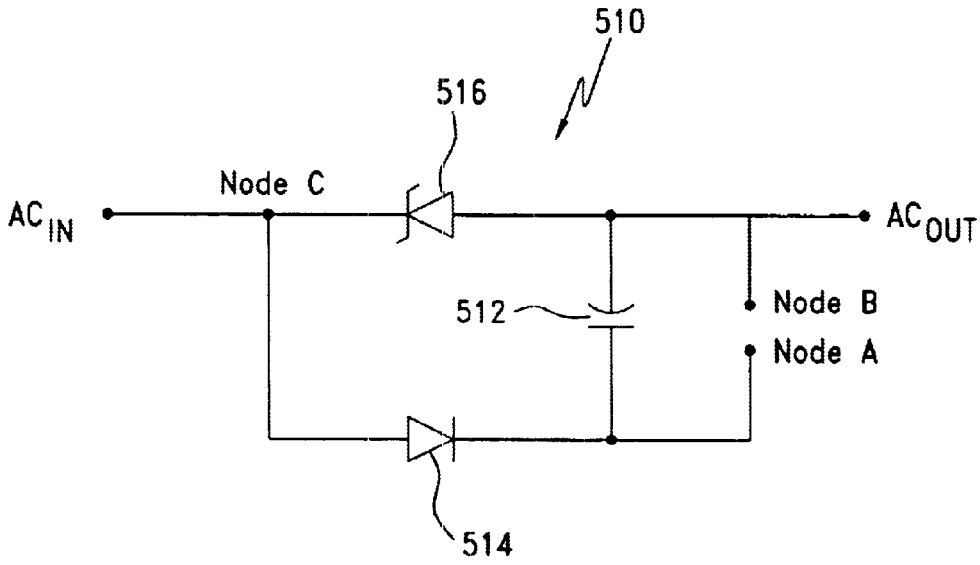
FIG. 7 is a circuit for switching AC to DC in accordance with the present invention.
Figures 8A, 8B, 8C:
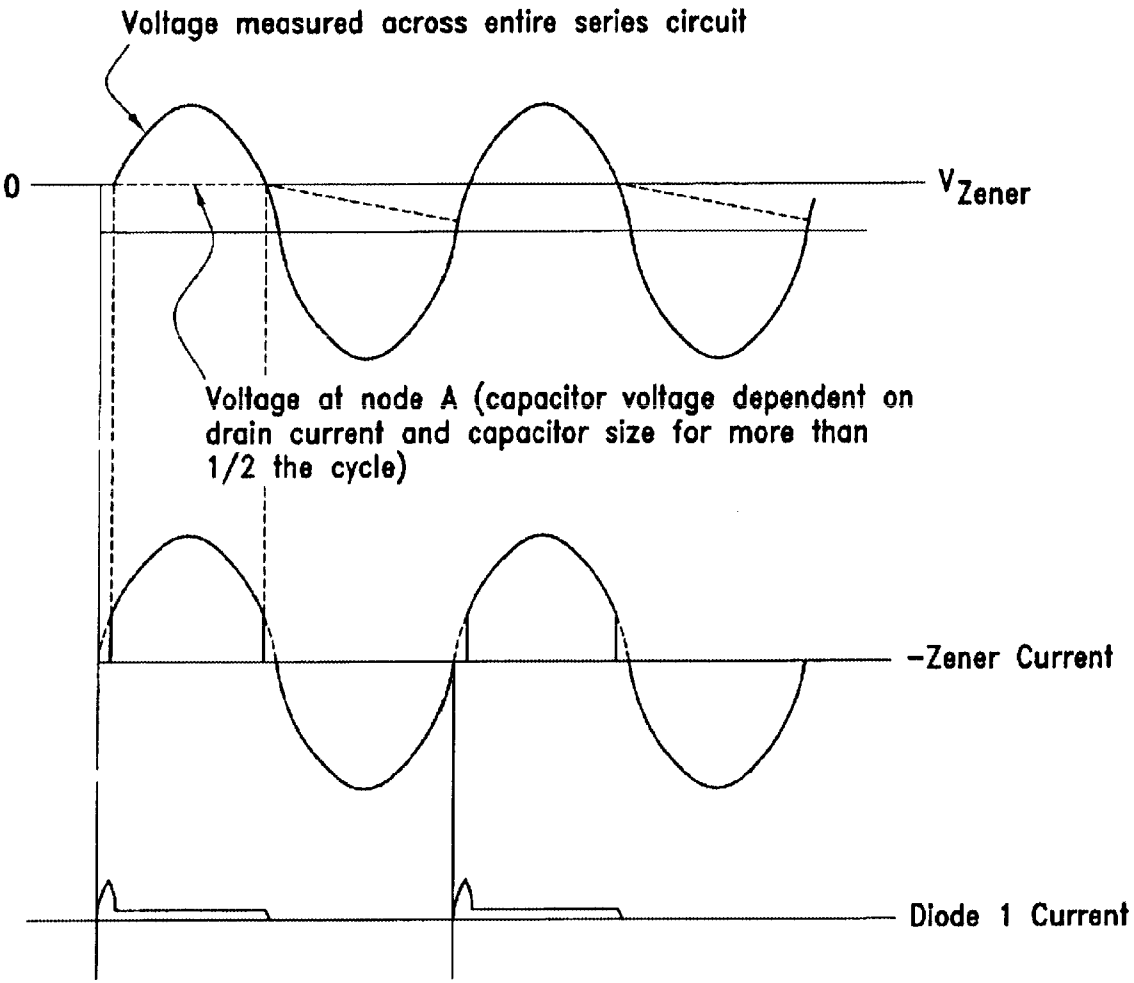
FIGS. 8*a*, 8*b* and 8*c* disclose various waveforms associated with the circuit shown in FIG. 7.
Figure 9A:
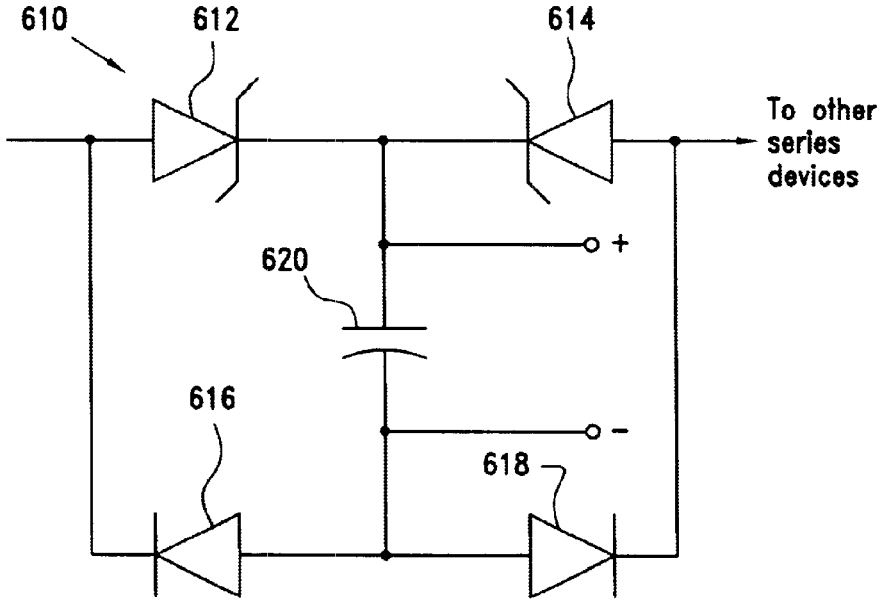
FIGS. 9*a* and 9*b* show an alternate circuit for use in accordance with the present invention.
Figure 9B:
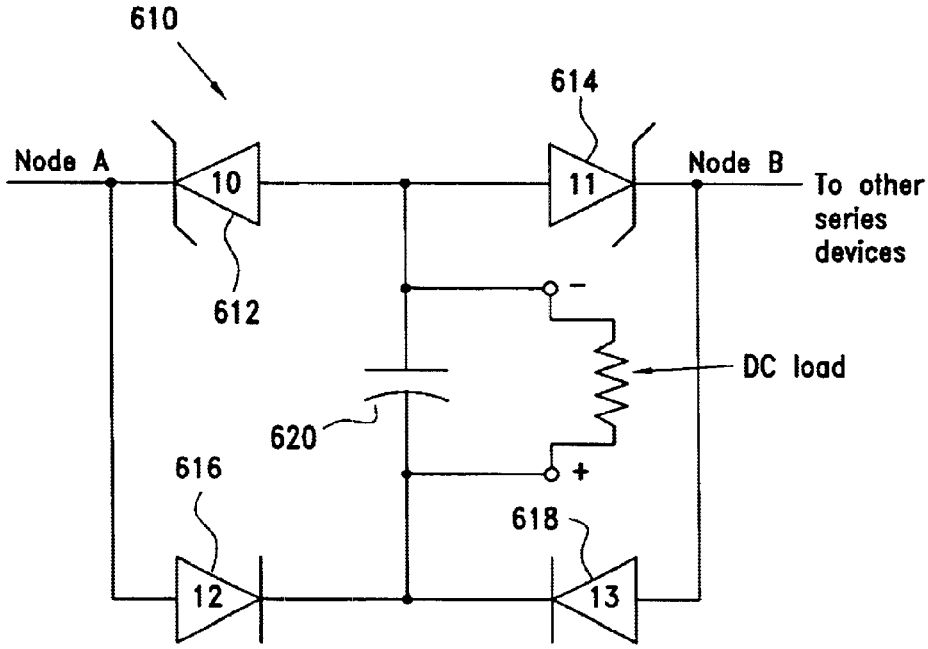

With reference to the various embodiments disclosed in FIGS. 7, 9*a* and 9*b*, the present invention applies zener diodes to allow the current to flow to other devices in series while producing a DC potential at the ornaments in accordance with the present invention. The concepts employed through the use of the circuit in accordance with the present invention is best understood by initially looking at FIG. 7. The circuit 510 disclosed in FIG. 7 shows a series connection with other AC devices, such as, light bulbs (not shown). When the voltage at node C is positive with respect to node B, but less than $V_{zener}$, current flows into the capacitor 512 through diode 514. When the voltage at node C (reference to node B) is greater than $V_{zener}$, current flows through the zener diode 516 to the other series devices. The voltages and currents associated with this circuit are shown in FIGS. 8*a*, 8*b* and 8*c*.

In order to reduce the capacitor requirements, a circuit as depicted in FIGS. 9*a* and 9*b* is provided. FIG. 9*a* shows the circuit 610 with the zener diodes 612, 614 cathode connected and the switching diodes 616, 618 anode connected. In contrast, FIG. 9*b* shows the zener diodes 612, 614 anode connected and the switching diodes 616, 618 cathode connected. In either of these configurations, the DC voltage is nearly constant, as is the current through the switching diodes 616, 618.

Figures 10A, 10B, 10C:
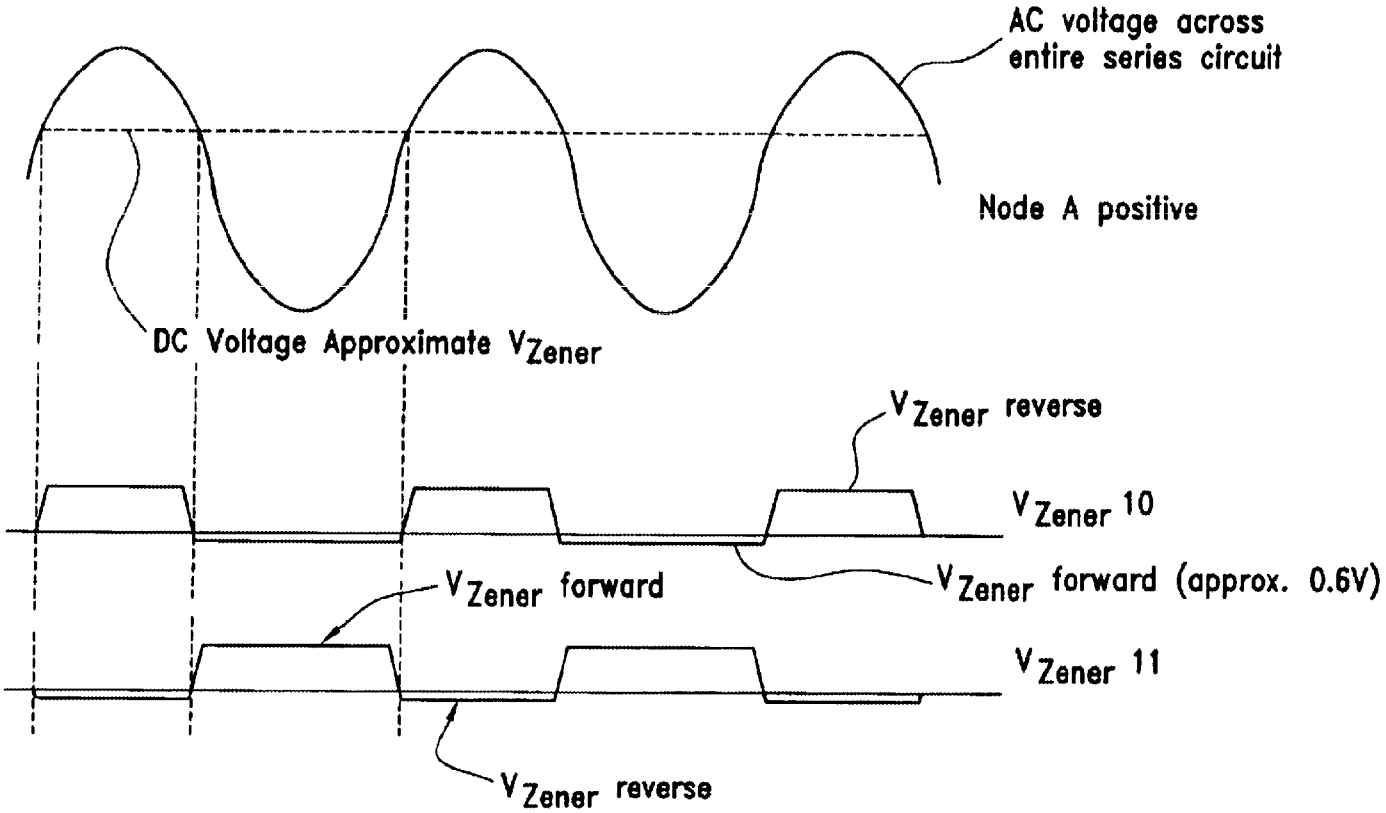
FIGS. 10*a–c* and 11*a–d* disclose various waveforms associated with the circuit shown in FIGS. 9*a* and 9*b*.
Figures 11A, 11B, 11C, 11D:
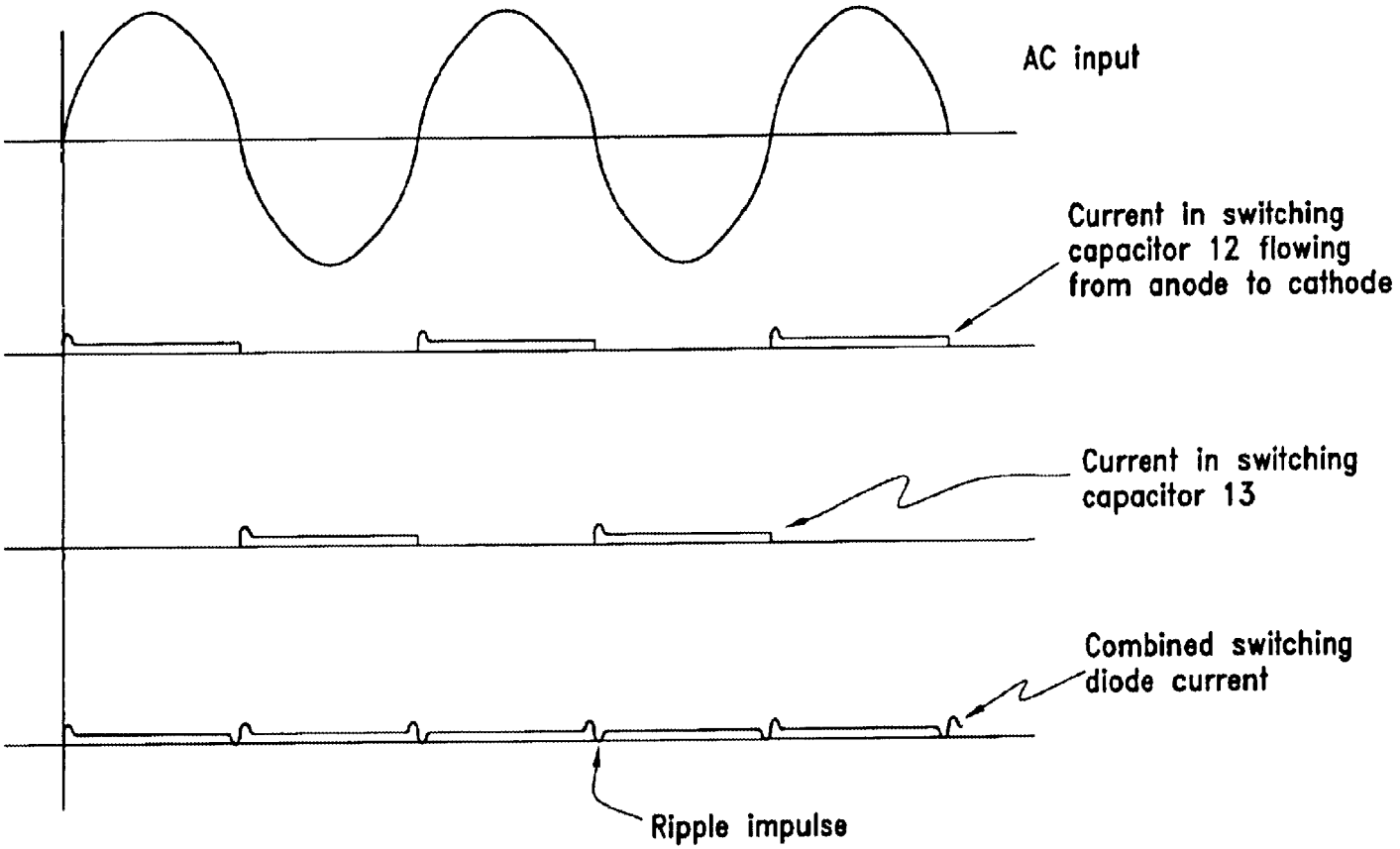

Referring to FIGS. 10*a*, 10*b* and 10*c*, the waveforms for the circuit are disclosed. Specifically, both zener voltages ($V_{zener}$) shown in reference to the cathode as being positive. From these signals, it is shown that a voltage closely approximating $V_{zener}$ is kept on the capacitor 620. As such, $$V_{capacitor}=V_{zener}(\text{reverse})-V_{switching\ diode}$$

Further referring to FIGS. 11*a*, 11*b*, 11*c* and 11*d*, it is shown that the combined currents in the switching diodes 616, 618 are nearly constant where the AC load is constant. The height of the ripple impulse is a function of the capacitor 620 size and DC load connected to the zener voltage. If the capacitor 620 is sufficiently large, the capacitor voltage does not degrade as much during zero crossing. As the zener voltage becomes smaller, the time that the AC voltage magnitude is less than the zener voltage becomes smaller.

The circuit disclosed in FIGS. 9*a* and 9*b* may be connected to a DC power source and still operate correctly. For example, if 6.2 volt zener diodes are used with silicon switching diodes having about 0.6 volt of drop, a DC voltage is produced of about 5.6 volts.

Figure 12:
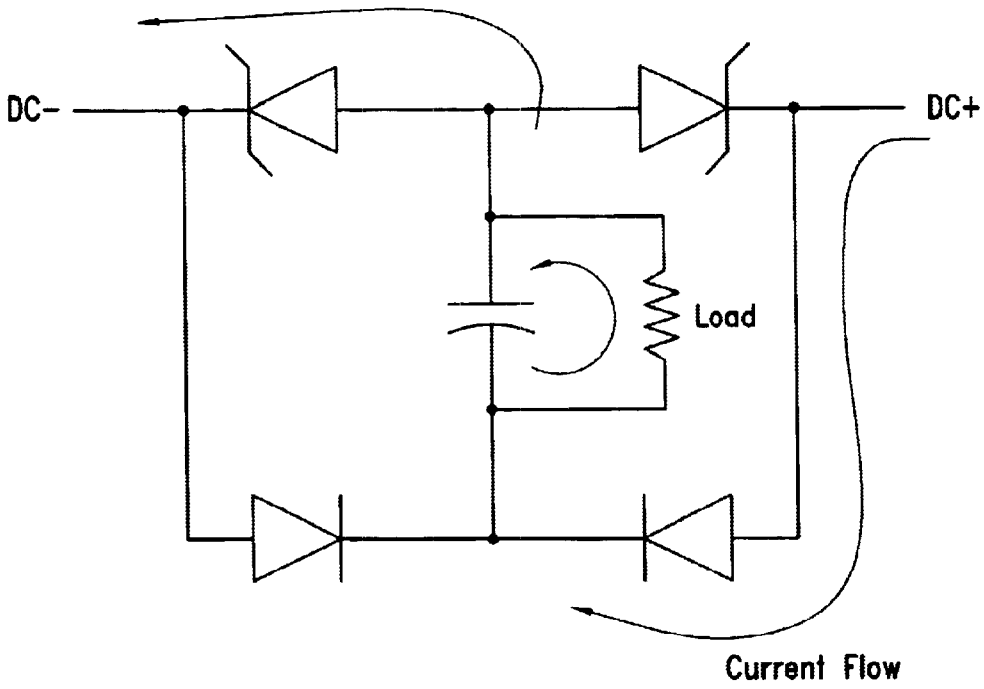
FIG. 12 is a circuit diagram showing that the circuit of FIGS. 9*a* and 9*b* will function properly regardless of the direction of the DC current.

If this device is disconnected from the AC circuit and connected to a DC source of less than $V_{zener}$, the circuit will operate properly regardless of the orientation of the DC voltage. In particular your attention is directed to the schematic shown in FIG. 12.

In summary, the circuit designed for use in accordance with the disclosed ornaments will correctly switch the DC voltage so the power supply or battery polarization is not necessary in a DC mode.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A circuit converting AC to DC such that DC potential is applied to a plurality of devices oriented in series, comprising:

an AC input;

an AC output;

a zener diode and a diode coupled between the AC input and the AC output without a capacitor connected in series therewith so as to permit the unrestricted flow of current through the zener diode and the diode, the zener diode and the diode connected between the AC input and the AC output for permitting free flow in respective opposite directions to thereby regulate the flow of electricity such that direct current is provided between first and second nodes to which a direct current device is selectively coupled without the need for a rectifier bridge; and at least one capacitor connected in parallel between the zener diode and the diode such that the capacitor functions to level the voltage within the circuit.

2. The circuit according to claim 1, further including a second zener diode and a second diode coupled between the AC input and the AC output without a capacitor connected in series therewith so as to permit the unrestricted flow of current through the second zener diode and the second diode, the second zener diode and the second diode regulating the flow of electricity such that direct current is provided between first and second nodes to which a direct current device is selectively coupled; and the at least one capacitor is connected in parallel between the second zener diode and the second diode such that the capacitor functions to level the voltage within the circuit.

3. The circuit according to claim 1, wherein the frequency at the AC input and the AC output of substantially the same.

4. The circuit according to claim 1, wherein the signal at the AC output is substantially unchanged from the signal at the AC input.

5. The circuit according to claim 1, wherein the zener diode and the diode are coupled between the AC input and the AC output, and alternating current is passed through both the zener diode and the diode.

6. The circuit according to claim 1, wherein the circuit includes at most a single AC input and at most a single AC output.

7. The circuit according to claim 1, wherein the zener diode is connected to the first node of the direct current device and the diode is connected to the second node of the direct current device.

8. The circuit according to claim 1, wherein alternating current is applied by the zener diode, diode and capacitor to produce DC voltage at the first and second nodes.

9. The circuit according to claim 2, wherein alternating current is applied by the zener diode, second zener diode, diode, second zener diode and capacitor to produce DC voltage at the first and second nodes.

* * * * *